United States Patent [19]

Scholl et al.

[11] 4,398,480

[45] Aug. 16, 1983

[54] FEEDING DEVICE FOR AN AUTOMATIC SEWING ARRANGEMENT

[75] Inventors: Hans Scholl, Oerlinghausen-Lipperreihe; Siegfried Vogt, Leopoldshöhe, both of Fed. Rep. of Germany

[73] Assignee: Kochs Adler AG, Bielefeld, Fed. Rep. of Germany

[21] Appl. No.: 404,986

[22] Filed: Aug. 4, 1982

[30] Foreign Application Priority Data

Aug. 28, 1981 [DE] Fed. Rep. of Germany ..... 3134028

[51] Int. Cl.[3] ..... D05B 21/00

[52] U.S. Cl. ..... 112/121.12

[58] Field of Search ..... 112/121.12, 121.15, 112/121.11, 308, 309

[56] References Cited

U.S. PATENT DOCUMENTS

| | | | |
|---|---|---|---|
| 3,358,626 | 12/1967 | Bryan | 112/121.12 |
| 3,474,747 | 10/1969 | Noiles | 112/121.12 |
| 3,543,737 | 12/1970 | Maschmann | 112/121.12 |
| 3,830,175 | 8/1974 | Levor | 112/121.12 |
| 3,983,825 | 10/1976 | Dobner et al. | 112/121.12 |
| 4,069,778 | 1/1978 | Kozawa | 112/121.12 |
| 4,088,085 | 5/1978 | Hager | 112/121.12 |
| 4,160,423 | 7/1979 | Scholl et al. | 112/121.12 |
| 4,282,819 | 8/1981 | Sartor | 112/121.12 |
| 4,347,797 | 9/1982 | Scholl et al. | 112/121.12 |

*Primary Examiner*—H. Hampton Hunter

*Attorney, Agent, or Firm*—Max Fogiel

[57] ABSTRACT

A feeding device for an automatic sewing arrangement producing a stitch row according to a predetermined contour in a workpiece is installed with a linkage system having a control disc. The linkage system is provided with a workpiece clamping plate movably arranged in a plane and operably connected to the control disc. Furthermore, the workpiece clamping plate is movably received on a drive-off-lever of the linkage system. A linear drive with control elements is provided for displacing the workpiece clamping plate and locking the latter in at least two positions. Control means for at least interrupting the sewing operation during the displacement of the workpiece clamping plate are provided at the linkage system.

9 Claims, 5 Drawing Figures

FEEDING DEVICE FOR AN AUTOMATIC SEWING ARRANGEMENT

BACKGROUND OF THE INVENTION

The present invention relates to a feeding device of an automatic sewing arrangement for producing a stitch contour in a workpiece according to a predetermined program. A linkage system installed with a control disc and a workpiece clamping plate operates upon a workpiece as a needle of a sewing head performs the stitching. In particular, a new feeding device installed with a linear drive, makes it possible to displace the workpiece relatively with respect to the linkage system.

Feeding devices of such types are known from the German laid-open DE-OS No. 30 00 831 and also from German Pat. DE-PS No. 27 33 397. These are installed essentially with a linkage system having a parallelogram-shaped configuration, in which two levers operating upon a stationary pivot point cooperate by cam followers with two grooves of a control disc. As the control disc is rotated for one revolution, the linkage system will be driven in a two-dimensional preset movement as controlled by the cams of the control disc. Due to their simple construction, such feeding devices operate reliably and are well-proven in the field. Furthermore, by simply exchanging the control disc, another program having a differently shaped switch contour may be achieved.

With such feeding devices the work area, i.e. the maximum of distances the workpiece holder is capable to be moved, is limited by the size of the linkage system. Depending on the application, it may happen that the work area of such a feeding device is not large enough as to sew a certain stitch program in a workpiece.

Accordingly, it is a main object of the present invention to create a feeding device of the aforesaid type so as to achieve an enlargement of the work area of the workpiece holder in a constructive manner.

Another object of the invention is to provide a feeding device with an extended work area and with control elements which make possible an automatic sewing process, in which the sewing process is automatically interrupted, the workpiece holder displaced, and the sewing process restarted again.

It is a further object of the present invention to provide a feeding device of the aforesaid type with a drive mechanism which is simple in construction and reliable in operation.

SUMMARY OF THE INVENTION

The objects of the present invention are achieved by displaceably arranging the workpiece holder at the drive-off lever of the linkage system of the feeding device. Drive means and control elements are provided to automatically control the process cycle and to lock the workpiece holder in different positions. With the arrangement of a pneumatically controlled cylinder as a linear drive for the workpiece holder, a simple and reliable system is achieved. The feeding device according to the invention allows to at least double the work area of the automatic sewing arrangement in one direction for producing stitch rows of larger dimensions.

Other objects, advantages and features of the present invention will appear from the detailed description of the preferred embodiment, which will now be explained in conjunction with the accompanying drawings.

DESCRIPTION OF THE PREFERRED EMBODIMENT

Figure 1:
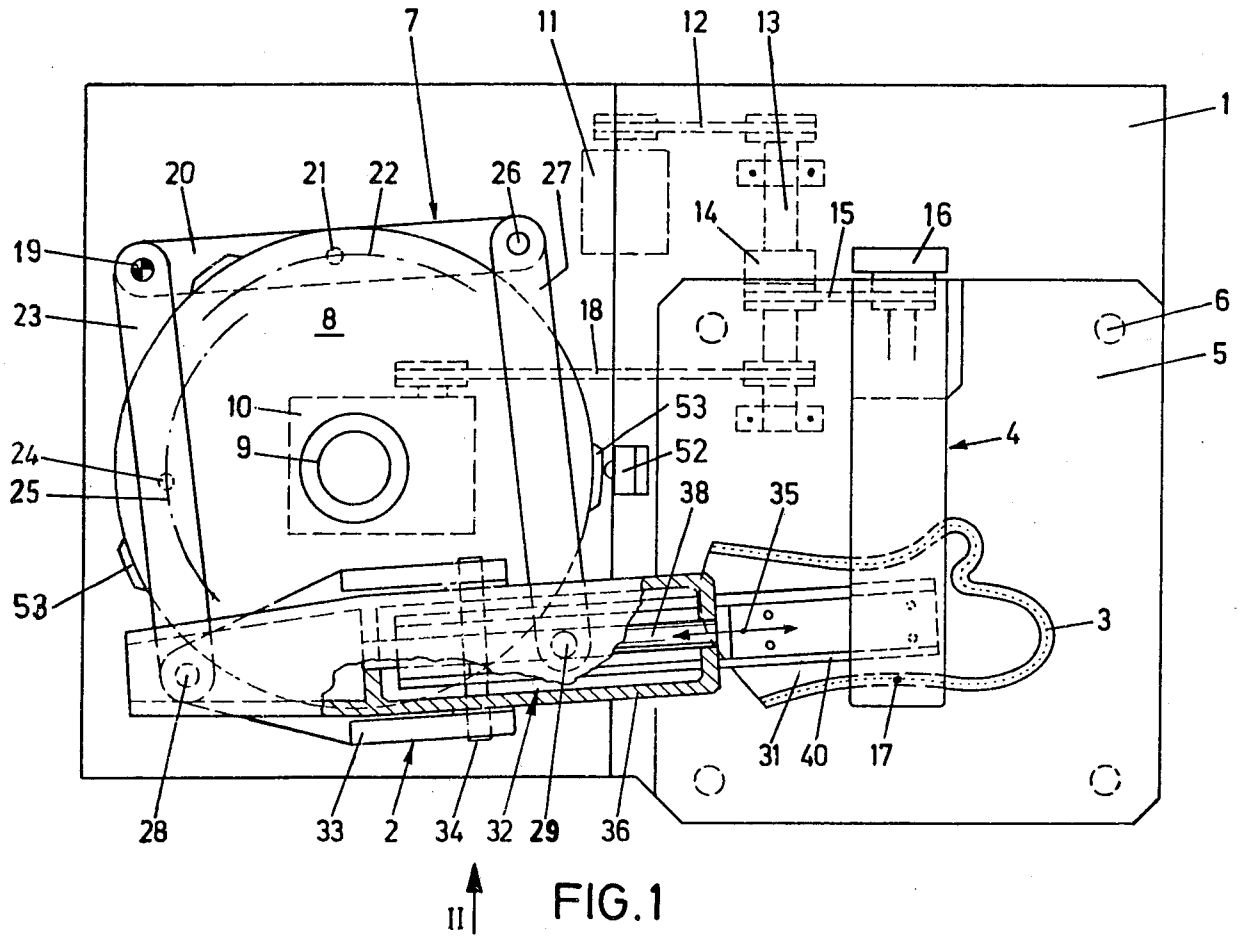
FIG. 1 is a top plan view of an automatic sewing arrangement including a feeding device according to the present invention.

The automatic sewing arrangement according to the drawing includes a stand 1 carrying a feeding device 2 with a workpiece 3 and a sewing machine designated as a sewing head 4. The sewing head 4 is mounted on a plate 5, which is supported with respect to the stand 1 by means of posts 6.

The feeding device 2 is provided with a linkage system 7, which in principle consists of links pivotally arranged in a configuration of a parallelogram, wherein two links cooperate with a control disc 8. The control disc 8 is secured to a drive shaft 9 of a gear 10 mounted at the stand 1. The control disc 8 is driven via the gear 10 by the drive motor 11 of the automatic sewing arrangement situated inside the stand 1. The motor 11 drives, via a belt drive 12, a shaft 13, which is connected via a clutch 14 and a further belt drive 15 to a handwheel 16 of the sewing head 4. Due to this drive connection a needle 17 of the sewing head 4 will be driven or not driven depending on the shift condition of the clutch 14. The shaft 13 is drivingly connected to the gear 10 by means of a further belt drive 18.

The linkage system 7 has a fixed fulcrum formed by an axis 19, which is secured to the stand 1. Pivotably received on the axis 19 is a lever 20, which is arranged beneath the control disc 8 and provided with a roller 21 engaging a control groove 22 located at the lower surface of the control disc 8.

Pivotally supported on the axis 19 is a further lever 23, which is arranged above the control disc 8, i.e. in parallel to the main direction of the sewing head 4. Also, this lever 23 is provided with a downwardly projecting guide roller 24 engaging a control groove 25 formed in the upper surface of the control disc 8. The control grooves 22, 25 each extend as closed grooves over the total circumference of the control disc 8. They have, of course, no circular configuration.

To the free end of the lower lever 20 there is, in parallel to and in the plane of the upper lever 23, hingedly connected an intermediate lever 27 by means of a link 26. To the free ends of the upper lever 23 and the intermediate lever 27 there is hinged by means of links 28, 29, a drive-off lever 30, which extends in parallel with the lower lever 20. The drive-off lever 30 extends in a plane above the upper lever 23 and the intermediate lever. The linkage system 7 defined by the four joints 19, 26, 28, 29 is a parallelogram-link-system having nearly right angles and equal shanks. To the drive-off lever 30 there is connected a workpiece clamping plate 31 engaging the workpiece 3. The sewing arrangement described thus far is known in principle and is usual in the trade and known, for example, from German laid-open DE-OS No. 30 00 831.

A linear drive 32 is pivotably received on a horizontal axis 34, which is supported in a bearing block 33 of the drive-off lever 30. Furthermore, the axis 34 extends about rectangularly to the direction of the arrow 35 of the linear drive 32, while the latter extends in parallel to a connecting line of the two links 28, 29.

The linear drive 32 is provided with an oblong housing 36, which is open at the bottom and supported in the bearing block 33. The tilting of this housing 36 and thus the whole linear drive 32 is performed by a pneumatically actuated piston-cylinder-drive 37, which is pivoted at the drive-off lever 30, on one hand, and pivoted at the housing 36, on the other hand. When actuated, the piston-cylinder drive 37 is shortened, so that the workpiece supporting plate 31 is swung upwardly from the position as shown in the drawing into a position not illustrated.

The housing 36 is provided with a guide rod 38 extending in parallel with the direction of the arrow 35. Slidably secured to the guide rod 38, in the direction of the arrow 35, there is a slide bearing 39, which carries a connecting lever 40. At the free end of the latter, there is mounted a workpiece supporting plate 31.

Moreover, in the housing 36 there is located a piston-cylinder drive 41, the cylinder 42 of which is axially secured by means of a bolt 43 in the housing 36. The piston rod 44 of the piston-cylinder drive 41 extending from the cylinder 42 in the direction to the sewing head 4, is connected by a bolt 45 to the slide bearing 39 and thus to the connecting lever 40.

In the cylinder 42 the piston rod 44 ends in a piston 46, which is bilaterally actuatable by compressed air lines. The latter will further be described hereinafter. Consequently, the piston 46 and thus the workpiece supporting plate 31 are pneumatically displaceable between two end positions.

At these end positions there are provided limit switches 47, 48 which may be in the form of proximity switches operating without any physical contact. For this purpose, for instance, to the piston 46 there is mounted a permanent magnet 49, which actuates reed switches 50 secured to the outer surface of the cylinder 42. When the magnet 49 actuates the reed switches 50, an electrical circuit 51 transmits a signal to an electronic control circuit (not shown).

To the stand 1 there is secured an electrical switch 52 cooperating with trigger cams 53 provided at the outer circumference of the control disc 8. In a determined angular position of the control disc 8, the trigger cams 53 initiate a switching operation and thus an electrical signal transmitted to the already-mentioned electronic control circuit.

The pneumatic actuation of the drive 41 is performed by a central compressed air source 54 via a supply line 55 which is connected to control valves 56, 57, from which the two already mentioned supply lines 58, 59 lead to the cylinder 42. The control valves 56, 57 are formed as 3/2-way solenoid valves and operated by the solenoids 60. Energizing is performed by the electronic control (not shown) via electrical circuits 61 or 62 and is dependent on a signal from the switch 52 or a signal from the limit switch 47 or 48. Due to the configuration of the control valves 56, 57 the piston 46 and thus also the workpiece supporting plate 31 together with the workpiece 3 are pneumatically locked in one of the two end positions of the correspondent limit switches 47, 48, as, in the correspondent end position, the piston 46 remains constantly exposed to compressed air.

Figure 4:
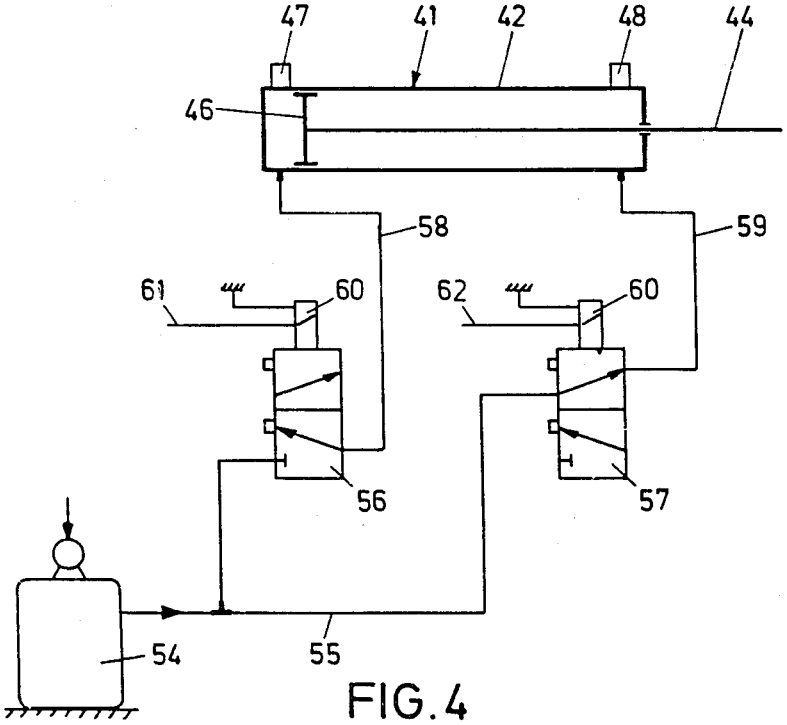
FIG. 4 shows a diagrammatic view for controlling a linear drive of the feeding device.

The operation of the feeding device according to the present invention may be described as follows:

For this operating description it may be assumed that the feeding device 2 is in such a position that the workpiece clamping plate 31 is placed as shown in FIG. 1 or FIG. 4, wherein, however, the workpiece clamping plate 31 is lifted off the plate 5 by the pulling action of the piston-cylinder-drive 37. After inserting the workpiece 3 between the workpiece clamping plate 31 and the plate 5, a signal is given to the control by the operator so as to clamp the workpiece 3 on the plate 5 where the workpiece clamping plate 31 is lowered by the piston-cylinder-drive 37. In order to assure sufficient pressure acting upon the workpiece 3, the drive-off-lever 30 is provided with an arm 63 reaching under the workpiece clamping plate 31. The arm 63 is installed with a thrust bearing 64 which is supported by a plate 65 firmly received by the posts 6.

Figure 5:
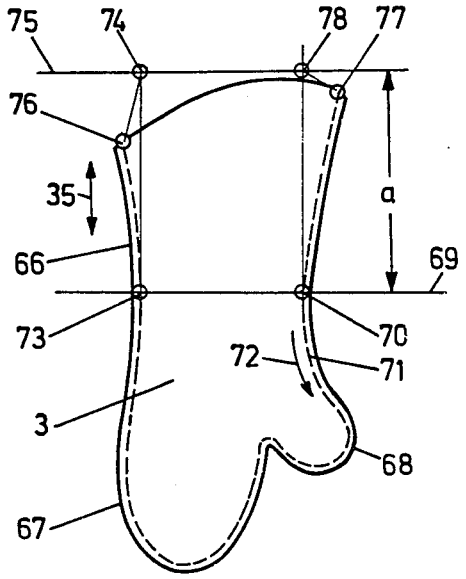
FIG. 5 shows a workpiece to be sewn and the required individual working steps.

The actual sewing process will now be explained in connection with FIG. 5, in which the workpiece 3 represents a mitten 67 formed with a cuff 66 and a thumb 68. The cuff 66 forms the opening of the mitten 67. As the clutch 14 is engaged, the drive motor 11 drives the sewing head 4, on the one hand, and the feeding device 2, on the other hand.

Figure 2:
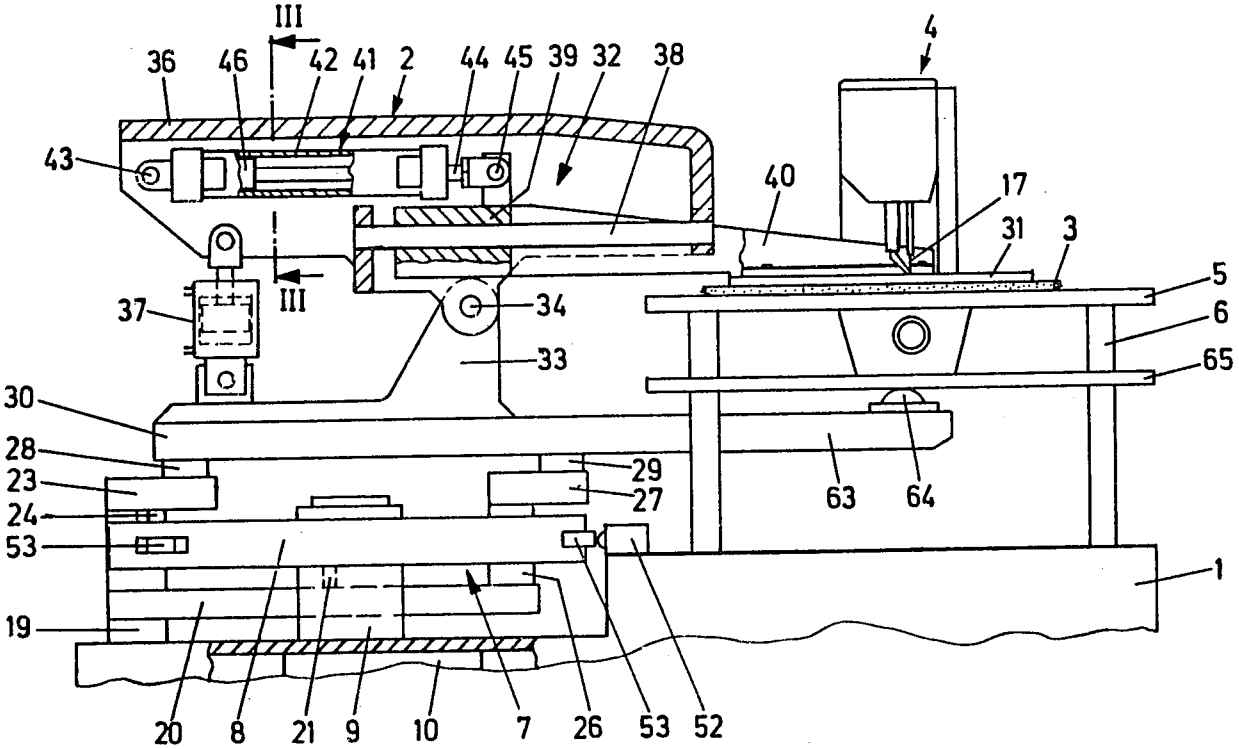
FIG. 2 is a side elevation taken in the direction of the arrow II shown in FIG. 1.
Figure 3:
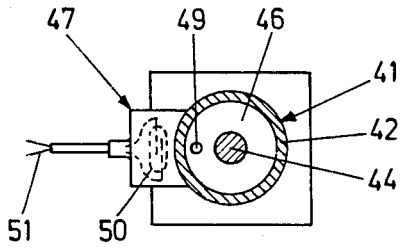
FIG. 3 is a sectional view of the feeding device taken along line III—III in FIG. 2.

The sewing operation starts at a point 70, which is placed on a cross line 69 positioned about in the range where the thumb 68 blends over in the cuff 66. The cross line 69 is placed so as to form at both sides, about equal halves of the mitten 67. In the direction of the arrow 72, the stitch row 71 is performed starting in point 70 and terminating in the first intermediate point 73, which is also positioned on the cross line 69, i.e. oppositely placed with respect to the point 70. As the first intermediate point 73 is reached, the switch 52 is operated by the trigger cam 53 causing a stop of the feeding device 2 and of the sewing head 4 where a thread cutting cycle is carried out. Consequently, by energizing the control valve 56 and de-energizing the control valve 57, the piston 46 with the piston rod 44 is operated by air pressure from an inner position as shown in FIGS. 2 and 4 into its outer position, at which the workpiece 3 is moved towards the operator for a distance "a" so as to finally position the needle 17 of the sewing head 4 above a second intermediate point 74 placed on a line 75, which is located outside of the area of the workpiece 3. Thus, the distance "a" equals the displacement distance performed by the linear drive 32. As shown, the displacement from the first intermediate point 73 to the second intermediate point 74 takes place in the direction of the arrow 35 which is directed perpendicular to the cross line 69.

As the second intermediate point 74 is reached, the limit switch 48 emits a signal triggering the disengaging of the clutch 14 for disconnecting the drive of the sewing head 4. In this phase, a displacement of the workpiece 3 is carried out by the linkage system 7, where the workpiece is moved by the drive motor 11 from the second intermediate point 74 to a point 76 with respect to the needle 17 of the sewing head 4. At this point a further signal is emitted by the switch 52 actuated by a corresponding trigger cam 53 so as to engage the clutch 14 and to consequently continue the sewing operation for performing the stitching to point 73. At this point, a further trigger cam 53 operates the switch 52 emitting a signal for stopping the drive motor 11, whereupon the sewing head 4 performs again a thread cutting cycle. Consequently, the clutch 14 will be disengaged so as to solely drive the workpiece clamping plate 31 with a workpiece 3 by the drive motor 11 in such a manner, that the point 70 of the workpiece 3 is positioned under the needle 17 of the sewing head 4. Due to a correspondent trigger cam 53, the switch 52 emits a further signal so as to engage the clutch 14 and to cause the drive motor 11 to start for terminating the sewing process, i.e. the stitch row 71 from point 70 to a point 77 located in the area of the parallel line 75 will be performed and terminated by a thread cutting cycle of the sewing head 4. Again by a correspondent trigger cam 53, the switch 52 emits a signal so as to disconnect the drive connection of the sewing head 4 and the control disc 8. Consequently, as a matter of sequential control, the control disc 8 is driven further, until the needle 17 of the sewing head 4 is positioned above a point 78 located on the line 75. The point 78 corresponds to the point 70, wherein both points are spaced by the distance of displacement "a". As the point 78 is reached, a final trigger cam 53 causes the switch 52 to emit a signal so as to stop the drive motor 11 and to engage the clutch 14. Furthermore, by this signal the control valves 56, 57 are oppositely energized or de-energized so as to cause a withdrawal of the workpiece clamping plate 31 by the action of air pressure on the piston 46 of the drive 41. As the piston 46 reaches its final position, i.e. its inner position, the limit switch 47 emits a signal so as to release the workpiece 3 due to the pull-action of the piston-cylinder drive 37 for removing the finished workpiece 3. As the control valves 56, 57 remain in the last-described shifted position, the piston 46 is locked in its position.

For allowing a displacing of the workpiece in two coordinate directions, a second linear drive may be installed by an adequate constructive adaption, wherein the second linear drive extends about in a horizontal plane, i.e. parallel to the plane of the first linear drive and perpendicular to the direction of displacement of the latter.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An automatic sewing arrangement for producing a stitch contour according to a predetermined program, comprising:

a stand;

a sewing head received on said stand, comprising: stitch forming means including a needle and a plate supporting a workpiece;

propelling means driving said sewing head, and a feeding device for feeding said workpiece with respect to said needle, comprising:

drive elements drivingly connected to said propelling means, including a shaft pivoted in said stand;

a control disc received on said shaft and having two control cams formed correspondingly to said program;

control means controlling the angular relation of said control disc with respect to said stand;

linkage means pivoted at said stand including two drive levers each installed with a cam follower cooperating with said control cams;

holder means supported by said plate for holding said workpieces, and a drive-off lever operably connected to said drive levers and having receiving means for receiving said holder means, said receiving means comprising bearing means for displaceably and lockably in at least two positions receiving said holder means, at least one of said control means being associated to each of said positions for interrupting the sewing process at least during a phase of said holder displacement.

2. A sewing arrangement according to claim 1, wherein said receiving means further comprises a linear drive motor operably connected to said holder means or to said drive-off lever.

3. A sewing arrangement according to claim 2, wherein said drive motor has two final positions.

4. A sewing arrangement according to claim 3, wherein said drive motor is formed as a medium-controlled piston-cylinder-means controlled by control valves controlling said medium.

5. A sewing arrangement according to claim 1, wherein said bearing means comprises a guide bar and a bearing slidably received on said guide bar, said bearing having an extension forming said holder means for said workpiece.

6. A sewing arrangement according to claim 3, wherein said drive motor comprises limit switch means arranged at each of said final positions.

7. An automatic sewing arrangement for producing a stitch contour according to a predetermined program, comprising:

a stand;

a sewing head received on said stand, comprising stitch forming means including a needle and a plate supporting a workpiece;

propelling means including a drive motor and a clutch for driving said sewing head, and a feeding device for feeding said workpiece with respect to said needle, comprising drive elements drivingly connected to said drive motor, including a shaft pivoted in said stand, a control disc received on said shaft and having two control cams formed correspondingly to said program, control means cooperating with said drive motor of said clutch and including trigger means arranged at said control disc, and detecting means for controlling the angular relation of said control disc with respect to said stand, linkage means pivoted at said stand including two drive levers, each provided with a cam follower cooperating with said control cams, holder means cooperating with said plate for holding said workpiece, and a drive-off lever operably connected to said drive levers and having a receiving means for receiving said holder means, said receiving means comprising:

bearing means arranged between said drive-off-lever and said holder means for displaceably and lockably in at least two positions receiving said holder means, said bearing means having a guide bar and a bearing slidably received on said guide bar;

at least one of said control means being associated to each of said positions for interrupting the sewing process at least during a phase of said holder displacement; and a linear drive motor operably connected to said holder means or to said drive-off-lever, said drive motor comprising a piston-cylinder-means driven by a medium, valves controlling said medium and controllably connected to said control means, and limit switch means associated to each of said holder positions.

8. A sewing arrangement according to claim 7, wherein said receiving means further comprises a housing connected to said drive-off-lever and receiving said guide bar and said linear drive motor.

9. A sewing arrangement according to claim 8, wherein said receiving means further comprises:

a pivot for tiltably mounting said housing to said drive-off lever, and a drive operably connected to said housing or to said drive-off-lever controlling said tilting movements as holding actions of said holder means.

* * * * *